US006056061A

United States Patent [19]

Ross et al.

[11] Patent Number: 6,056,061

[45] Date of Patent: May 2, 2000

[54] APPARATUS FOR COMPLETING A SUBTERRANEAN WELL AND ASSOCIATED METHODS

[75] Inventors: Colby M. Ross, Carrollton; Ralph H. Echols, Dallas, both of Tex.

[73] Assignee: Halliburton Energy Services, Inc., Dallas, Tex.

[21] Appl. No.: 09/372,453

[22] Filed: Aug. 11, 1999

Related U.S. Application Data

[62] Division of application No. 08/924,490, Aug. 27, 1997, Pat. No. 5,971,070.

[51] Int. Cl.[7] ..... E21B 33/12

[52] U.S. Cl. ..... 166/387; 166/127; 166/128; 166/141

[58] Field of Search ..... 166/387, 118, 166/126–128, 141, 179

[56] References Cited

U.S. PATENT DOCUMENTS

| | | | |
|---|---|---|---|
| 4,898,245 | 2/1990 | Braddick | 166/387 |
| 5,297,629 | 3/1994 | Barrington et al. | 166/297 |

*Primary Examiner*—Roger Schoeppel
*Attorney, Agent, or Firm*—William M. Imwalle; Marlin R. Smith

[57] ABSTRACT

Apparatus for completing a subterranean well and associated methods provide economical and efficient well completions. In one described embodiment, a well completion apparatus includes a packer which is settable by application of a compressive axial force thereto. The packer sealingly engages a wellbore of the well when set therein, but does not anchor to the wellbore. The apparatus further includes a screen and an attachment device. The attachment device permits the apparatus to be attached to another packer previously set and anchored within the wellbore.

6 Claims, 5 Drawing Sheets

APPARATUS FOR COMPLETING A SUBTERRANEAN WELL AND ASSOCIATED METHODS

This is a division, of application Ser. No. 08/924,490, filed Aug. 27, 1997, now U.S. Pat. No. 5,971,070, such prior application being incorporated by reference herein in its entirety.

BACKGROUND OF THE INVENTION

The present invention relates generally to completion operations performed in subterranean wells and, in an embodiment described herein, more particularly provides a gravel packing apparatus and methods.

Downhole assemblies utilized in formation fracturing and/or gravel packing operations in subterranean wells typically include a sealing device, such as a packer specially designed for the purpose, a filtration device, such as a screen or slotted liner, and various other items of equipment for controlling fluid flow therethrough. In general, the packer is set in a wellbore of the well prior to commencement of fluid or slurry flow in the formation fracturing or gravel packing operation. In some cases, the assembly is sealingly engaged at its lower end with a sump packer set in the wellbore below a formation intersected by the wellbore.

It is usually the case that, after the completion operation is concluded, a production tubing string is connected to the assembly and the special purpose packer becomes, in effect, a production packer. Unfortunately, the special purpose packer is generally much more expensive than a normal production packer. Thus, the well operator is required to pay the higher cost of the special purpose packer even though, after the completion operation is concluded, all that is needed is a normal production packer. Therefore, it would be quite desirable to provide a packer which may be utilized in completion operations, such as formation fracturing and gravel packing, but which may be produced at or below the cost of a normal production packer.

Additionally, it is common for special purpose packers utilized in formation fracturing and gravel packing operations to be provided with slips for anchoring the packer to the wellbore (or anchoring to protective casing lining the wellbore). These slips are generally formed of hardened material, so that they are able to bite into and thereby deform the inner surface of the wellbore. As used herein, the term "anchoring" is used to describe this operation whereby one or more elements of a packer or other sealing device bite into the inner surface of the wellbore or wellbore lining. As used herein, the term "setting" is used to describe an operation in which a packer or other sealing device is sealingly engaged with the inner surface of the wellbore or wellbore lining. Additionally, if the packer or other sealing device includes elements, such as slips, for biting into the inner surface of the wellbore or wellbore lining, the term "setting" also includes anchoring.

Unfortunately, the slips, or other anchoring devices, are difficult to mill when subsequent operations require removal of the packer from the wellbore. Of course, the packer may be provided as a retrievable type, wherein the slips are retractable for ease of removal of the packer, but such retrievable packers typically cost more than a normal production packer, due to the added expense of the retrieving mechanism. Thus, it would be desirable to provide the packer for use in the completion operation with the packer being free of slips for anchoring the packer to the wellbore. Additionally, it would be desirable to provide the packer made partially or wholly of easily millable materials, such as aluminum, plastic, etc.

To prevent axial movement of the assembly during, and subsequent to, the completion operations, the assembly could be attached to the sump packer, or abutted against a surface in the wellbore, such as the bottom of the wellbore. Therefore, it would also be desirable to provide the assembly having an attachment member or an abutment member connected thereto. Furthermore, it would be desirable for the packer to be settable in the wellbore by application of a compressive axial force thereto, the force being resisted by the sump packer or the wellbore surface contacted by the abutment member.

In addition, the above considerations are applicable, with appropriate modifications, to other sealing devices used in subterranean wells. For example, it would be desirable to provide a casing patch which is free of slips for anchoring the casing patch to the wellbore or wellbore lining, which is made partially or wholly of easily millable materials, which has an attachment member or an abutment member connected thereto, and/or which is settable by application of a compressive axial force thereto.

SUMMARY OF THE INVENTION

In carrying out the principles of the present invention, in accordance with an embodiment thereof, an apparatus is provided which includes a packer devoid of slips for anchoring the packer within a wellbore, and settable by applying a compressive axial force thereto. The apparatus may also include an abutment member or an attachment device for attaching the apparatus to another packer, such as a sump packer. Associated methods of completing subterranean wells are also provided.

In broad terms, a disclosed method of completing a subterranean well includes setting a first packer in the well and then latching an assembly thereto. The assembly includes a second packer, a screen, and a latching device, the screen being positioned between the second packer and the latching device. The first packer anchors the assembly in the well while the completion operation is performed. The second packer sealingly engages the wellbore, but is not anchored thereto.

In another disclosed method, the assembly is not latched to another packer, but is instead abutted against a surface in the wellbore prior to setting the packer. In this manner, the packer may be set by applying at least a portion of the weight of a tubing string thereto. The weight of the tubing and the abutting relationship prevents displacement of the assembly during the completion operation.

In yet another disclosed method, multiple assemblies are provided which are attached to each other downhole, so that completion operations may be performed for corresponding multiple formations intersected by the wellbore. Thus, each of the assemblies includes a packer, a screen and an attachment device, with the screen being interconnected between the packer and the attachment device. The assemblies may either be conveyed into the well individually, or may be attached to each other initially and conveyed into the well together.

A packer is provided by the present invention as well. The packer does not include any anchoring device. In operation, a displacement member is displaced relative to an inner mandrel to thereby sealingly engage a circumferential seal element with the wellbore. A slip member may be provided for preventing displacement of the displacement member in a direction relative to the inner mandrel.

Additionally, another apparatus is provided by the present invention which includes a first seal surface formed internally on an inner mandrel of a packer. A port is formed through a sidewall portion of the packer and a second internal seal surface is formed on a tubular member attached to the packer, so that the port is axially straddled by the seal surfaces. Alternatively, a generally tubular member may be interconnected between the packer and a screen, the tubular member having the port and seal surfaces formed thereon.

The apparatus and methods provided by the present invention reduce costs associated with completion operations and increase their efficiency. These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
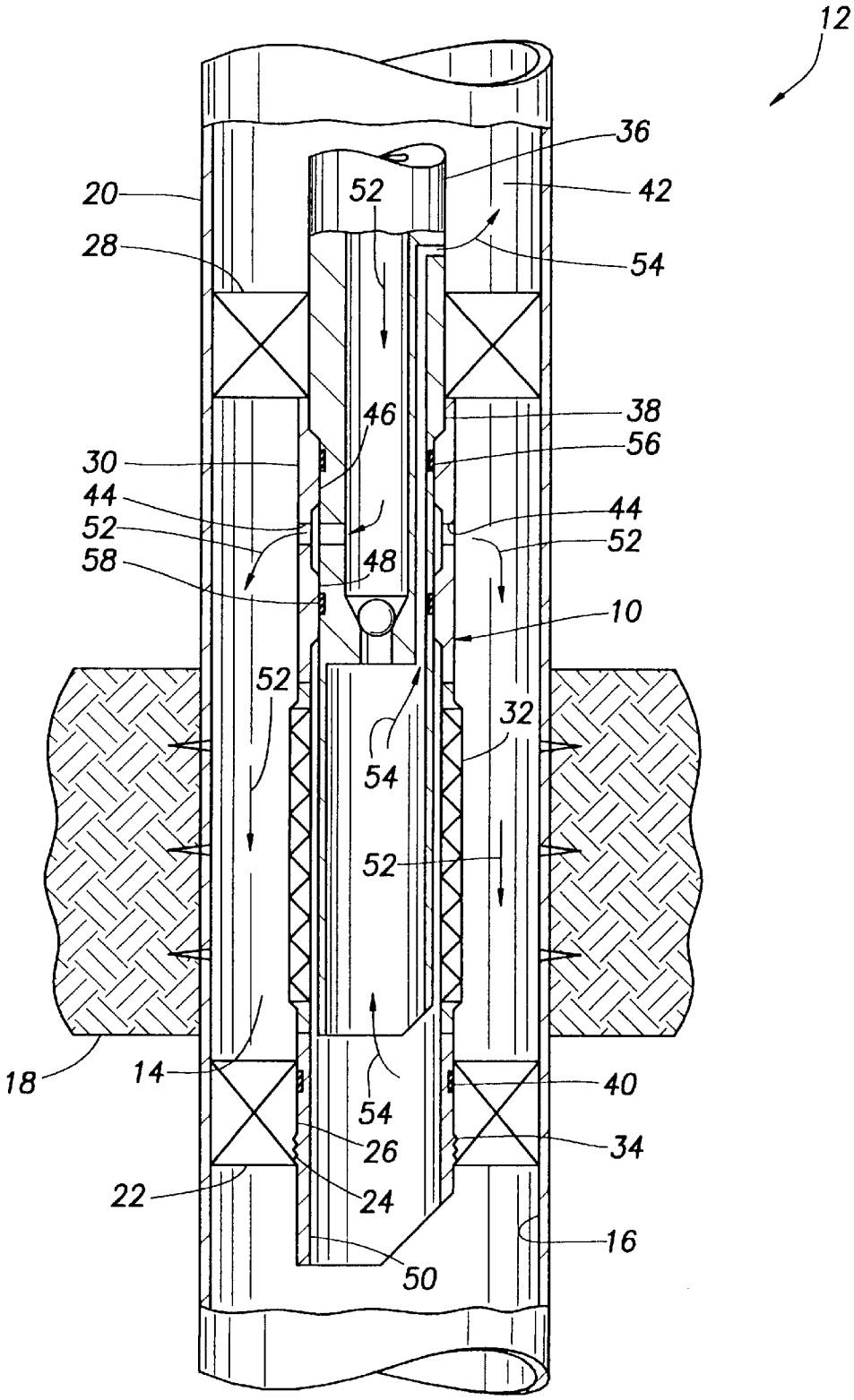
FIG. 1 is a schematic cross-sectional view of a first gravel packing assembly and method of completing a subterranean well, the first assembly and method embodying principles of the present invention.

Representatively and schematically illustrated in FIG. 1 is an assembly 10 which embodies principles of the present invention. In the following description of the assembly 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The assembly 10 will be described herein in the context of a gravel packing operation, which is a type of completion operation well known to those of ordinary skill in the art. However, it is to be clearly understood that the assembly 10, and other apparatus and methods described herein, may be utilized in other operations without departing from the principles of the present invention. For example, the assembly 10 may easily be utilized in a formation fracturing operation.

Also representatively and schematically illustrated in FIG. 1 is a method 12 of completing a subterranean well. The method 12 will be described herein in the context of a gravel packing operation in which it is desired to deposit a gravel pack (not shown in FIG. 1) in an annulus 14 formed radially between the assembly 10 and a wellbore 16 of the well. As discussed above, it is not necessary for a gravel packing operation to be performed in the method 12 according to the principles of the present invention.

The wellbore 16 intersects a formation, zone or interval of a formation 18. A perforated protective liner or casing 20 lines the wellbore 16 at the intersection of the wellbore and the formation 18. The casing 20 may be cemented in place, but for clarity of illustration, such cement is not shown. However, it is to be understood that the method 12 may be performed in an uncased wellbore without departing from the principles of the present invention.

An anchoring device, such as a sump packer 22, is conveyed into the wellbore 16 and set therein generally below the formation 18. The sump packer 22 is preferably of the type which includes an anchoring device, such as slips, which bite into the inner side surface of the wellbore 16 (i.e., the inner side surface of the casing 20 if the wellbore is cased) when the packer is set therein. The sump packer 22 also sealingly engages the inner side surface of the wellbore 16. An acceptable packer for use as the sump packer 22 is a PERMA-SERIES® manufactured by, and available from, Halliburton Company of Duncan, Okla., although any of a variety of other packers may be utilized for the sump packer without departing from the principles of the present invention.

The sump packer 22 is provided with an attachment or latching device 24 and an internal seal surface 26. The latching device 24 may be an annular recess configured for receipt of a collet therein, a J-slot, internal threads, a RATCH-LATCH® device (available from Halliburton Company), or other latching device, without departing from the principles of the present invention. For example, the PERMA-SERIES® packer is available with a RATCH-LATCH® head and axially extending seal bore.

After the sump packer 22 has been set in the wellbore 16, the assembly 10 is conveyed into the wellbore. The assembly 10 is representatively illustrated as including a packer 28, a generally tubular ported member 30, a slotted liner or screen 32 and a latching device 34. It is to be understood that the assembly 10 may include more or less elements than those representatively illustrated without departing from the principles of the present invention. For example, multiple screens 32, blank tubular sections (not shown), valves (such as a sliding sleeve valve or an MCS™ closing sleeve available from Halliburton Company), other completion equipment, such as perforating guns, etc. may be provided in the assembly 10.

The assembly 10 may be conveyed into the wellbore 16 on wireline, coiled tubing, production tubing, a work string 36 which includes a service tool 38, etc. As shown in FIG. 1, the assembly 10 is conveyed by, and operatively engaged with, the service tool 38. The service tool 38 may be any of a variety of tools, such as a Multi-Position Tool available from Halliburton Company.

Where the service tool 38 is utilized to convey the assembly 10, the work string 36 and the assembly 10 are lowered into the wellbore 16 together, the service tool 38 being releasably secured to the assembly 10, such as by shear pins, collets, lugs, etc. The latching device 34 is engaged with the latching device 24 of the sump packer 22 and a circumferential seal 40 carried externally on the assembly proximate the latching device 34 is sealingly engaged with the seal surface 26 of the sump packer. Since the sump packer 22 is anchored to the wellbore 16, and the latching devices 24, 34 are engaged with each other, the assembly 10 is thereby prevented from displacing axially relative to the wellbore 16. In this important aspect of the present invention, it should be noted that the assembly 10 is effectively anchored within the wellbore 16, even though the packer 28 has not been set therein at this point in the method 12, and no other portion of the assembly has grippingly and/or bitingly engaged the inner side surface of the wellbore.

The packer 28 does not include any slips or other anchoring device for anchoring the packer or assembly 10 to the wellbore 16. The packer 28 is, however, capable of sealingly engaging the inner side surface of the wellbore 16. Therefore, the packer 28 may be set in the wellbore 16 to provide fluid isolation between the annulus 14 below the packer and an annulus 42 above the packer extending to the earth's surface. The packer 28 may include an internal seal bore, fluid passages, etc. not shown in FIG. 1, but which are commonly found in packers designed for gravel packing operations, such as the VERSA-TRIEVE® packer available from Halliburton Company. Additionally, packers embodying principles of the present invention are described hereinbelow, each of which may be utilized for the packer 28.

The ported member 30 has a series of circumferentially spaced apart fluid ports 44 formed generally radially therethrough. The ports 44 are axially straddled by a pair of axially extending seal bores 46, 48 formed internally on the ported member 30. It is to be understood that the ported member 30 may actually be more than one element of the assembly 10, that is, the ports 44 may be formed on one tubular member, while the seal bore 48 may be formed on an attached other tubular member, etc. For example, the upper seal bore 46 may actually be formed on an internal mandrel of the packer 28. Thus, the ported member 30 may be otherwise configured without departing from the principles of the present invention.

The latching device 34 and seal 40 of the assembly 10 are configured for cooperative engagement with the latching device 24 and seal surface 26, respectively, of the sump packer 22. For example, the latching devices 24, 34 may combinatively make up a RATCH-LATCH® assembly. Additionally, the latching device 34 may have a bore 50 extending axially therethrough for providing fluid communication with the wellbore 16 below the sump packer 22, or the latching device 34 may be internally solid or have a bull plug attached thereto to prevent such fluid communication. Of course, the seal 40 may be carried internally on the sump packer 22, instead of being carried externally on the assembly 10, without departing from the principles of the present invention.

Preferably, the packer 28 is of the type described more fully hereinbelow, which is settable by application of a compressive axial force thereto. However, it is to be understood that the packer 28 may be otherwise settable without departing from the principles of the present invention. For example, the packer 28 may be an inflatable packer, which is settable by applying a predetermined fluid pressure to the interior of the work string 36, the packer 28 may be settable by rotation and/or reciprocation of the work string, etc. Additionally, the packer 28 may be settable by radially outwardly extending one or more circumferential seal elements (not shown in FIG. 1) carried thereon, for example, by displacing a mandrel which has a radially enlarged surface formed thereon relative to the seal elements, by generating internally any forces needed to set the packer (such as by utilizing POV technology, fluid pressure, etc.). In short, any method of setting the packer 28 may be utilized without departing from the principles of the present invention.

In the method 12, after the latching devices 24, 34 have been engaged, a compressive axial force is applied to the packer 28 to thereby set the packer in the wellbore 16. As described above, the packer 28, when set, sealingly engages the wellbore 16 without anchoring thereto. The compressive axial force is applied preferably by slacking off on the work string 36 at the earth's surface, thereby applying at least a portion of the work string's weight to the packer 28. Since the latching devices 24, 34 are engaged at this point, the sump packer 22 resists this axial force (the sump packer being anchored to the wellbore 16).

Note that the screen 32 is spaced apart from the sump packer 22 so that when the latching devices 24, 34 are engaged, the screen is positioned opposite the formation 18. Thus, when the packer 28 is set, the screen 32 is properly positioned within the wellbore 16, and the anchoring engagement of the sump packer 22 with the wellbore prevents displacement of the screen relative thereto during setting of the packer 28 and thereafter.

With the packer 28 set in the wellbore 16, a gravel-laden slurry (indicated by arrows 52) may be circulated from the earth's surface, through the service tool 38, radially outward through the ports 44, and into the annulus 14. Of course, if a formation fracturing operation were being performed, the slurry 52 may include proppant, if an acidizing operation were being performed, the slurry may actually be an acidic solution, etc. A fluid portion (indicated by arrows 54) of the slurry 52 may enter the formation 18 and/or may pass inwardly through the screen 32, into the service tool 38, and into the annulus 42 for return to the earth's surface. Sealing engagement of axially spaced apart circumferential seals 56, 58 with the seal bores 46, 48, respectively, facilitates directing flow of the slurry 52 and fluid portion 54 through the service tool 38 and assembly 10.

When the completion operation is concluded, the service tool 38 may be disengaged from the assembly 10, and the service tool 38 and work string 36 retrieved to the earth's surface. The ports 44 may remain open or may be closed during or after removal of the service tool 38 therefrom, for example, an MCS™ closing sleeve may be utilized to close the ports 44 as the service tool is withdrawn from the assembly 10. A production tubing string (not shown in FIG. 1, see FIG. 3) may be engaged with the assembly 10 for production of fluids from the formation 18 to the earth's surface. In this case, the packer 28 performs the function of a production packer.

If subsequent remedial operations require removal of the packer 28 from the wellbore 16, the packer may be easily milled, since it does not include any slips or other anchoring devices. It will, thus, be readily appreciated that, in addition to being economical to manufacture, and convenient and efficient in operation; the packer 28, and the overall assembly 10, facilitate ease of performance of remedial operations in the wellbore 16.

Figure 2:
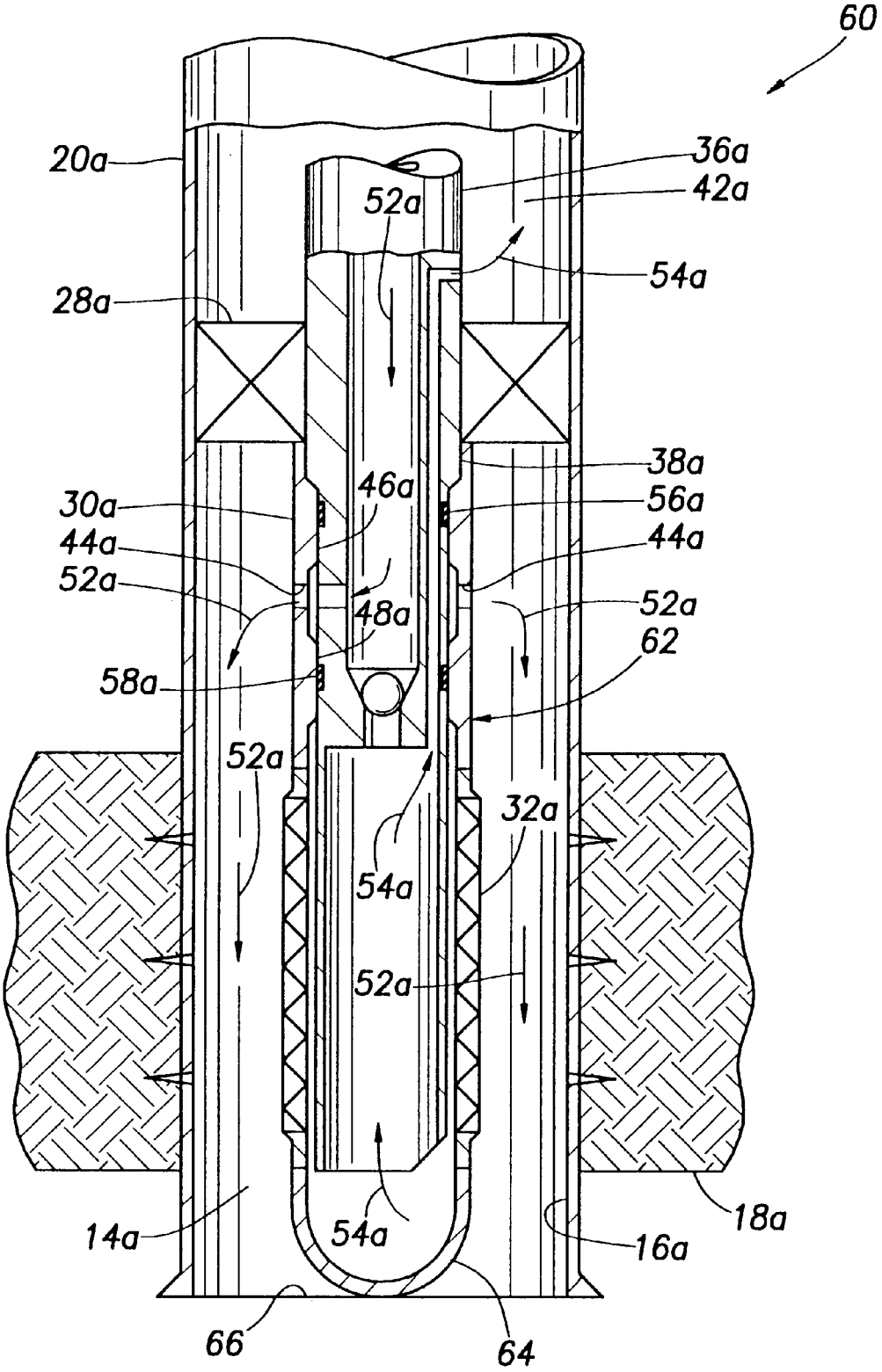
FIG. 2 is a schematic cross-sectional view of a second gravel packing assembly and method of completing a subterranean well, the second assembly and method embodying principles of the present invention.

Referring additionally now to FIG. 2, a method 60 of completing a subterranean well is schematically and representatively illustrated. Elements shown in FIG. 2 which are similar to previously described elements are indicated in FIG. 2 utilizing the same reference numerals, with an added suffix "a". In the method 60, an assembly 62 is utilized which is somewhat similar to the assembly 10 in the method 12, but which permits even greater cost savings in its use.

The assembly 62 includes the packer **28*a*, ported member 30*a*, screen 32*a*, and an abutment member 64 attached to a lower end of the assembly. The abutment member 64 is configured to axially contact a surface within the wellbore 16***a* to thereby prevent further axially downward displacement of the assembly 62 relative to the wellbore. As shown in FIG. 2, the abutment member 64 is in axial contact with a bottom side surface 66 of the wellbore 16*a*, but it is to be understood that the abutment member may alternatively contact other surfaces therein, such as a shoulder formed internally on the casing 20*a*, a surface formed on a casing shoe, etc.

As shown in FIG. 2, the abutment member 64 also closes off a lower end of the screen 32*a*, thereby preventing fluid flow therethrough. In this case, the abutment member 64 may be a bull plug. It is to be understood, however, that it is not necessary for the abutment member 64 to close off an end of the assembly 62, and the abutment member may be other than a bull plug, in keeping with the principles of the present invention.

In the method 60, the assembly 62 and work string 36*a* are conveyed together into the wellbore 16*a*, the service tool 38*a* being operatively engaged with the assembly, although they may be separately conveyed thereinto. Eventually, the abutment member 64 axially contacts a surface, such as the wellbore bottom 66, and prevents further axially downward displacement of the assembly 62. The screen 32*a* is axially spaced apart from the abutment member 64 as required to position the screen opposite the formation 18*a* when the abutment member contacts the surface 66.

At this point, the packer 28*a* is set within the wellbore 16*a*. For example, a portion of the work string 36*a* weight may be applied to the packer 28*a* by slacking off at the earth's surface. However, as discussed above in relation to setting of the packer 28 in the method 12, the packer 28*a* may be otherwise set without departing from the principles of the present invention. When set, the packer 28*a* sealingly engages, but does not anchor to, the casing 16*a*.

Completion operations may then be performed by, for example, circulating a slurry 52*a* through the work string 36*a* and into the annulus 14*a*. The fluid portion 54*a* may be returned to the earth's surface after passing inwardly through the screen 32*a* and into the annulus 42*a*. Note that, in the method 60 it is the weight of the work string 36*a* which prevents axially upward displacement of the assembly 62 relative to the wellbore 16*a* during the completion operations. If, however, the completion operation does not require application of fluid pressure to the annulus 14*a*, it may not be necessary to maintain the weight of the work string 36*a* on the packer 28*a* after the packer has been set. Note, also, that the method 60 does not require utilization of a sump packer and, thus, may be even more economical and convenient in operation than the previously described method 12.

Figure 3:
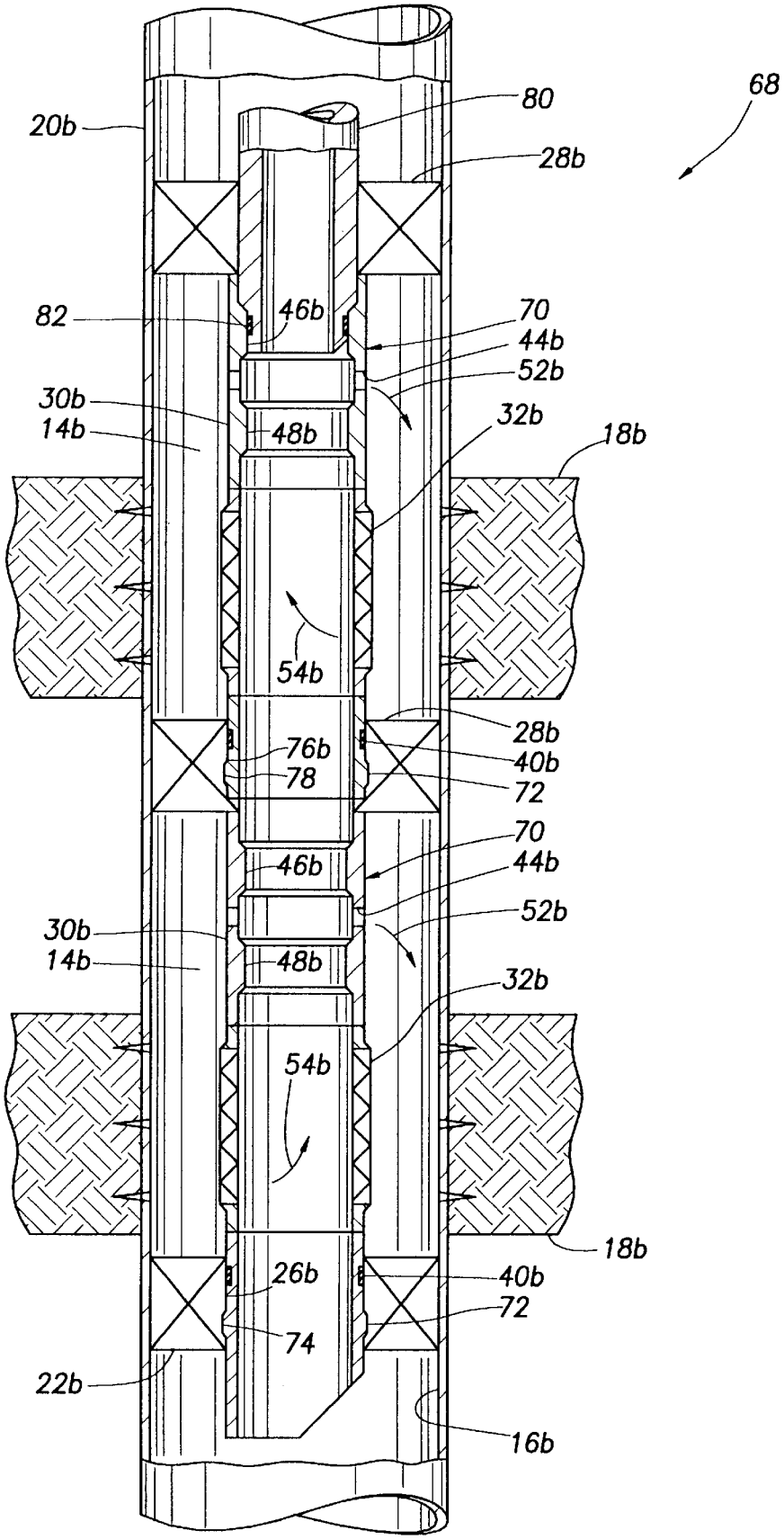
FIG. 3 is a schematic cross-sectional view of a third gravel packing assembly and method of completing a subterranean well, the third assembly and method embodying principles of the present invention.

Referring additionally now to FIG. 3, another method 68 of completing a subterranean well is schematically and representatively illustrated. Elements shown in FIG. 3 which are similar to previously described elements are indicated in FIG. 3 utilizing the same reference numerals, with an added suffix "b". The method 68 utilizes multiple assemblies 70 in completion operations involving corresponding multiple formations 18*b*. Some methods of completing multiple zones of subterranean wells are disclosed in U.S. Pat. Nos. 4,105,069 and 4,270,608, the disclosures of which are incorporated herein by this reference.

In the method 68, the sump packer 22*b* is set in the wellbore 16*b*, thereby anchoring the sump packer therein. A lower one of the assemblies 70 is then conveyed into the wellbore 16*b* or, alternatively, the sump packer 22*b* and assembly may be conveyed into the wellbore together. Preferably, the assembly 70 is conveyed into the wellbore 16*b* operatively engaged with a service tool and associated work string (not shown in FIG. 3, see FIG. 1).

A latching device 72 attached to the assembly 70 is engaged with a cooperatively configured latching device 74 on the sump packer 22*b*. As shown in FIG. 3, the latching device 72 is a series of circumferentially spaced apart collets and the latching device 74 is an annular recess formed internally on the sump packer 22*b*, but it is to be understood that other latching devices may be utilized without departing from the principles of the present invention. When the latching devices 72, 74 are engaged, the seal 40*b* sealingly engages the seal bore 26*b*.

The lower packer 28*b* may then be set by, for example, applying an axially compressive force thereto as described above. When set, the packer 28*b* sealingly engages, but does not anchor to, the wellbore 16*b*. After the lower packer 28*b* is set, completion operations may be performed, such as gravel packing the annulus 14*b* between the lower assembly 70 and the lower formation 18*b*. Alternatively, completion operations may be deferred until the upper assembly 70 is installed, and the completion operations for both the upper and lower formations 18*b* may be performed simultaneously.

The lower packer 28*b* has a seal bore 76 and latching device 78 which may be similar to the seal bore 26*b* and latching device 74 of the sump packer 22*b*. In this manner, the upper assembly 70 may be connected to the lower assembly 70, with the sump packer 22*b* providing anchoring engagement with the weilbore 16*b* for both assemblies.

When the lower packer 28*b* is set in the wellbore 16*b*, the lower screen 32b is positioned opposite the lower formation 18*b*. Similarly, when the upper assembly 70 is conveyed into the wellbore 16*b* and the upper packer 28*b* is set therein, the upper screen 32*b* is positioned opposite the upper formation 18*b*. Thus, it will be readily appreciated that, appropriately configured, any number of assemblies 70 may be stacked and positioned relative to a corresponding number of formations 18*b* intersected by the wellbore. For example, the upper packer 28*b* may be provided with the seal bore 76 and latching device 78, so that another assembly 70 may be attached thereto. Eventually, however, the anchoring engagement of the sump packer 22*b* with the wellbore 16*b* may be insufficient for the number of assemblies 70 attached thereto, and so it may become necessary to periodically provide one or more of the assemblies 70 having a packer that does include an anchoring device (e.g., one packer with an anchoring device for every three or four packers which do not include an anchoring device).

When the completion operations are concluded and it is desired to produce fluid from one or more of the formations 18*b*, a production tubing string 80 may be engaged with the upper assembly 70. The production tubing string 80 may carry a circumferential seal 82 externally thereon for sealing engagement with the upper seal bore 46*b*. Alternatively, or in addition thereto, the production tubing string 80 may be provided with a seal 40*b* and latching device 72 similar to those utilized on the assemblies 70, and the upper packer 28*b* may be provided with the cooperatingly configured seal bore 76 and latching device 78 as provided on the lower packer 28*b*, so that the production tubing string may be sealingly and latchingly engaged with the upper assembly 70 in a manner similar to that in which the upper assembly is engaged with the lower assembly.

Note that the completion operations may be performed separately or simultaneously for the individual formations 18*b* intersected by the wellbore 16*b*. Additionally, fluid from each of the formations 18*b* may be separately or simultaneously produced. As shown in FIG. 3, the assemblies 70 are configured for simultaneous production of fluid from each of the formations 18*b*, but it will be readily appreciated that if the ports 44*b* of each of the assemblies were selectively closeable, separate production of fluid from a selected one or more of the formations 18*b* could be achieved. For example, the tubular members 30*b* could be provided including a conventional sliding sleeve valve for selective closure of the ports 44*b*. The incorporated patents disclose additional methods which may be utilized to provide separate or simultaneous gravel packing of the individual annuluses 14*b*.

Figure 4:
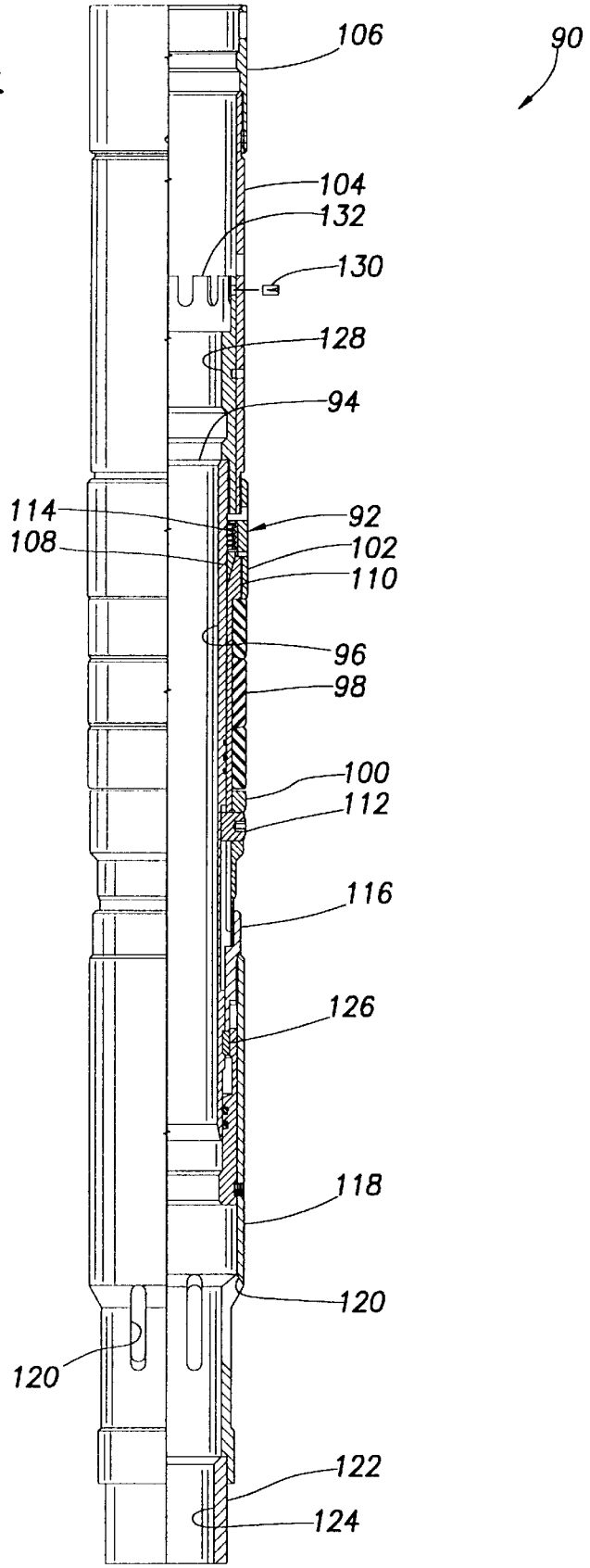
FIG. 4 is a partially cross-sectional and partially elevational view of an apparatus which may be utilized in the first, second and third assemblies and methods, the apparatus embodying principles of the present invention.

Referring additionally now to FIG. 4, an apparatus 90 is representatively illustrated, which may be utilized in the assemblies 10, 62, 70 and methods 12, 60, 68. The apparatus 90 includes a packer 92 which is settable by application of a compressive axial force thereto, and which does not include an anchoring device, such as slips, for anchoring the packer to a wellbore. The packer 92 is similar in many respects to the VERSA-TRIEVE® packer available from Halliburton Company.

The packer 92 includes a generally tubular and axially extending inner mandrel 94. A seal bore 96 is internally formed on the inner mandrel 94. The seal bore 96 may serve as the upper seal bore 46 in the assembly 10, however, it is to be understood that it is not necessary for the seal bore 96 to be formed on the inner mandrel 94 in accordance with the principles of the present invention.

Radially outwardly surrounding the inner mandrel 94 is a set of circumferential seal elements 98. The seal elements 98 are axially retained between an element retainer 100 and a displacement member 102. In order to set the packer 92, the displacement member 102 is displaced axially toward the element retainer 100, thereby compressing the seal elements 98 therebetween and forcing at least a portion of the seal elements radially outward.

The displacement member 102 is threadedly attached to an upper sub 104. In the methods 10, 60, 68, the upper sub 104 may be attached to the service tool 38 by means of an adaptor 106, or may be attached directly thereto. Alternatively, the adaptor may be configured for wireline conveyance of the apparatus 90 into a wellbore.

When an axially inwardly directed force is applied to the displacement member 102 via the upper sub 104, the displacement member is biased axially downward to compress the seal elements 98. To prevent subsequent upward displacement of the displacement member 102 and resulting decompression of the seal elements 98, a series of generally wedge shaped circumferentially spaced apart slips 108 are disposed about the inner mandrel 94 and provided with serrated or toothed inner surfaces for gripping the outer side surface of the inner mandrel. Upward displacement of the displacement member 102 will cause the slips 108 to be radially inwardly urged by an inclined face formed on a sleeve 110 adjacent the slips. The slips 108 are maintained in contact with the sleeve 110 by a compression spring 114. The sleeve 110 is threadedly attached to the displacement member 102, and a portion of the sleeve is disposed radially between the seal elements 98 and the inner mandrel 94.

An anti-rotation lug 112 is threadedly installed through the element retainer 100 and into an axially extending recess formed on the outer side surface of the inner mandrel 94. The element retainer 100 is threadedly attached to an intermediate member 116 which, in turn, is threadedly attached to a generally tubular lower housing 118.

The lower housing 118 has a series of circumferentially spaced apart ports 120 formed generally radially therethrough, the ports being somewhat axially inclined as shown in FIG. 4. The ports 120 may be utilized for the previously described ports 44, in which case the lower housing 118 may form a portion of the ported member 30. A generally tubular member 122 having an internal axially extending seal bore 124 may be threadedly attached to the lower housing 118, and the seal bore 124 may be utilized as the lower seal bore 48 of the ported member 30. Thus, the ported member 30 of the assembly 10 may be provided by individual members of the apparatus 90, the seal bore 96 corresponding to the seal bore 46, the ports 120 corresponding to the ports 44, and the seal bore 124 corresponding to the seal bore 48.

A shear ring 126 releasably secures the inner mandrel 94 against axial displacement relative to the element retainer 100, intermediate member 116 and lower housing 118. When it is desired to retrieve the apparatus 90 after the packer 92 has been set within a wellbore, an axially upwardly directed force may be applied to the inner mandrel 94, for example, at internal threads 128 formed on a top sub 132 threadedly attached to the inner mandrel, to shear the shear ring 126 and permit the inner mandrel and displacement member 102 to displace axially upward, thereby decompressing the seal elements 98. Thus, the packer 92 does not have to be milled if subsequent remedial operations are to be performed in the wellbore.

Elements of the packer 92 may be formed from easily millable materials, which may include plastic, aluminum, etc. Thus, in addition to being free of external slips for gripping engagement with a wellbore, the packer 92 may include other features which enhance its convenience of use.

A shear pin 130 may be installed through the top sub 132 to assist in utilization of the packer 92 in conjunction with a service tool, such as the Multi-Position Tool available from Halliburton Company.

Thus has been described the apparatus 90 which includes the packer 92 that is settable by application of an axially compressive force thereto and which does not include any device for anchoring the packer to a wellbore. In addition, the apparatus 90 includes portions which may be utilized for the ported member 30 in the methods 10, 60, 68 described hereinabove.

It will be readily apparent to one of ordinary skill in the art that the packer 92 may be easily converted to operate as a casing patch. When utilized as a casing patch, the packer 92 would preferably include an additional set of seal elements 98 carried thereon, axially spaced apart from the seal elements shown in FIG. 4. In this manner, the converted packer 92 may be set within casing, with the sets of seal elements 98 axially straddling an opening formed through the casing. When converted and used as a casing patch, the packer 92 may not include the seal bores 96, 124 and ports 120 of the apparatus 90.

Figure 5:
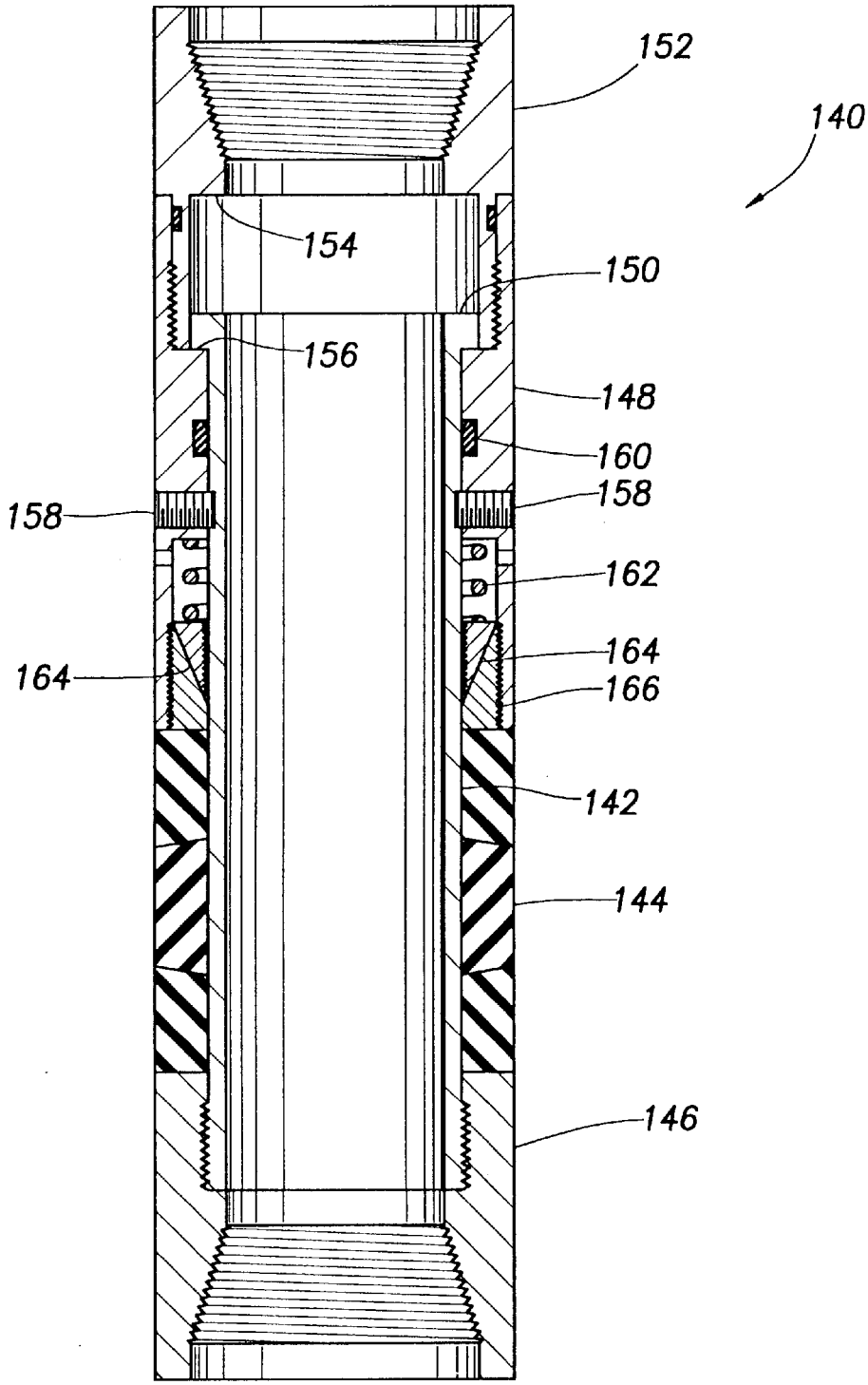
FIG. 5 is a schematic cross-sectional view of a packer which may be utilized in the apparatus of FIG. 4, and in the first, second and third assemblies and methods, the packer embodying principles of the present invention.

Referring additionally now to FIG. 5, a packer 140 is schematically and representatively illustrated, the packer embodying principles of the present invention. The packer 140 may be utilized for the packer 28 in the method 10. The packer 140 is settable by application of a compressive axial force thereto and does not include any slips or other anchoring device for anchoring the packer to a wellbore.

The packer 140 includes a generally tubular and axially extending inner mandrel 142 and a set of circumferential seal elements 144 disposed radially outwardly about the inner mandrel. The inner mandrel 142 is threadedly attached to an element retainer 146, which prevents axially downward displacement of the seal elements 144 relative to the inner mandrel.

The seal elements 144 are axially retained between the element retainer 146 and a generally tubular displacement member 148 axially slidingly disposed externally on the inner mandrel 142. An upper radially enlarged portion 150 of the inner mandrel 142 is axially slidingly disposed within an upper sub 152. The upper sub 152 is threadedly and sealingly attached to the displacement member 148. The portion 150 of the inner mandrel 142 is axially retained between internal shoulders 154, 156 formed on the upper sub 152 and displacement member 148, respectively.

The displacement member 148 is releasably secured against axial displacement relative to the inner mandrel 142 by shear screws 158 threadedly installed through the displacement member and into an annular recess formed on the outer side surface of the inner mandrel. Sealing engagement between the displacement member 148 and the outer side surface of the inner mandrel 142 is provided by a circumferential seal 160 carried internally on the displacement member.

A compression spring 162 maintains an axially downwardly directed biasing force on a set of generally wedge-shaped slip members 164 circumferentially spaced apart about the inner mandrel 142 outer side surface. Engagement of the slips 164 with a complimentarily configured slip retainer 166 radially inwardly biases the slips to grippingly engage the inner mandrel 142 outer side surface and prevent the displacement member 148 from displacing axially upward relative to the inner mandrel. For this purpose, each of the slips 164 has a serrated or toothed inner side surface.

Elements of the packer 140 may be formed from easily millable materials, which may include plastic, aluminum, etc. Thus, in addition to being free of external slips for gripping engagement with a wellbore, the packer 140 may include other features which enhance its convenience of use.

When it is desired to set the packer 140 within a wellbore, an axially compressive force is applied to the upper sub 152 and element retainer 146. The shear screws 158 shear when the force reaches a predetermined level, and permit the displacement member 148 to axially downwardly displace relative to the inner mandrel 142. The seal elements 144 are axially compressed between the displacement member 148 and the element retainer 146, thereby causing at least a portion of the seal wellbore. The internal slips 164 maintain to sealing engagement with the wellbore. The internal slips 164 maintain the displacement member 148 in this position (axially compressing the seal elements 144), even though the axially compressive force may be subsequently removed from the packer 140.

It will be readily apparent to one of ordinary skill in the art that the packer 140 may be easily converted to operate as a casing patch. When utilized as a casing patch, the packer 140 would preferably include an additional set of seal elements 144 carried thereon, axially spaced apart from the seal elements shown in FIG. 5. In this manner, the converted packer 140 may be set within casing, with the sets of seal elements 144 axially straddling an opening formed through the casing.

Of course, modifications, additions, substitutions, deletions, etc. may be made to the apparatus and methods described herein, which modifications, etc. would be obvious to one of ordinary skill in the art, and such changes are contemplated by the principles of the present invention. As examples of suitable modifications, either or both of the packers 90, 140 described herein may be configured for setting by other than application of a compressive axial force thereto, for example, the packers may be set by displacing a mandrel having a radially enlarged surface formed thereon relative to the seal elements 98, 144, the force needed to set the packers may be applied by rotation, reciprocation, etc. of a tubing string attached thereto, by a setting device attached thereto, or the force may be generated internally, or result from fluid pressure applied thereto, etc. Accordingly, the foregoing detailed description is to be clearly understood as being given by way of illustration and example only, the spirit and scope of the present invention being limited solely by the appended claims.

What is claimed is:

1. Apparatus for providing sealing engagement with a wellbore of a subterranean well, the apparatus comprising:

a generally tubular inner mandrel having a first seal surface formed internally thereon;

a generally tubular member having a port formed through a sidewall portion thereof and a second seal surface formed internally thereon, the port being disposed axially between the first and second seal surfaces;

at least one circumferential seal element radially outwardly disposed relative to the inner mandrel;

a displacement member, the displacement member being displaceable relative to the seal element to thereby displace at least a portion of the seal element radially outward; and the apparatus being free of any member configured for anchoring the apparatus to the wellbore.

2. The apparatus according to claim 1, further comprising a slip member disposed adjacent the displacement member, the slip member being configured to grippingly engage the inner mandrel to thereby prevent displacement of the displacement member relative to the inner mandrel.

3. The apparatus according to claim 2, wherein the slip member is further configured to prevent displacement of the displacement member relative to the inner mandrel in a first direction and permit displacement of the displacement member relative to the inner mandrel in a second direction opposite to the first direction.

4. The apparatus according to claim 1, wherein the displacement member is axially displaceable relative to an element retainer, the seal element being disposed axially between the displacement member and the element retainer, and wherein the seal element is radially outwardly extendable by displacing the displacement member axially relative to the element retainer.

5. The apparatus according to claim 4, wherein the displacement member is displaceable relative to the element retainer by applying a compressive axial force to the displacement member and element retainer to thereby radially outwardly extend the seal element.

6. The apparatus according to claim 1, further comprising an attachment device for attaching the apparatus to an item of equipment within the wellbore, the attachment device being connected to one of the inner mandrel and the displacement member.

* * * * *